US005160387A

United States Patent [19]

Sujansky

[11] Patent Number: 5,160,387

[45] Date of Patent: Nov. 3, 1992

[54] EMULSION EXPLOSIVE

[75] Inventor: Vladimir Sujansky, Burwood, Australia

[73] Assignee: ICI Australia Operations Proprietary Limited, Melbourne, Australia

[21] Appl. No.: 614,456

[22] Filed: Nov. 16, 1990

[30] Foreign Application Priority Data

Nov. 16, 1989 [AU] Australia ..... PJ7440

[51] Int. Cl.[5] ..... C06B 45/00

[52] U.S. Cl. ..... 149/2; 149/44; 149/46; 149/61; 149/76; 149/83

[58] Field of Search ..... 149/2, 44, 46, 61, 76, 149/83

[56] References Cited

U.S. PATENT DOCUMENTS

| | | | |
|---|---|---|---|
| 4,500,370 | 2/1985 | Hajto | 149/2 |
| 4,509,998 | 4/1985 | Hajto | 149/2 |
| 4,710,148 | 12/1987 | Nagaoka | 446/464 |
| 4,764,230 | 8/1988 | Bates et al. | 149/21 |
| 4,775,431 | 10/1988 | Mullay | 149/8 |
| 4,784,706 | 11/1988 | McKenzie | 149/2 |
| 4,822,433 | 4/1989 | Cooper et al. | 149/2 |
| 4,828,633 | 5/1989 | Forsberg | 149/2 |
| 4,840,687 | 6/1989 | Forsberg et al. | 149/2 |
| 5,074,939 | 12/1991 | Sanders et al. | 149/2 |

FOREIGN PATENT DOCUMENTS

| | | |
|---|---|---|
| 0330375 | 8/1989 | European Pat. Off. . |
| 0331306 | 9/1989 | European Pat. Off. . |
| 0331430 | 9/1989 | European Pat. Off. . |
| 8703613 | 6/1987 | PCT Int'l Appl. . |
| 8905785 | 6/1989 | PCT Int'l Appl. . |
| 8905848 | 6/1989 | PCT Int'l Appl. . |
| 2187182 | 12/1989 | United Kingdom . |

*Primary Examiner*—Stephen J. Lechert, Jr.
*Attorney, Agent, or Firm*—Cushman, Darby & Cushman

[57] ABSTRACT

An emulsion explosive comprising a discontinuous oxygen-releasing salt phase, a continuous fuel phase and an emulsifier blend, said emulsifier blend comprising a first emulsifier component consisting of at least one emulsifier comprising a lipophilic moiety, being a polymer of a $C_2$ to $C_6$ olefin, and a hydrophilic moiety, being derived from an amine wherein the HLB of the first emulsifier component, as herein defined, is in the range of from 1.0 to 1.3 and a second emulsifier component and wherein the HLB of the emulsifier blend, as herein defined is in the range of from 1.4 to 3.0. Compositions of the present invention combine not only ease of formation and long term stability but also provide significant advantages in the refinement of emulsions and exhibit improved tolerance to shear allowing repumping and greater ease of handling.

27 Claims, No Drawings

EMULSION EXPLOSIVE

This invention relates to an explosive composition and in particular to an emulsion explosive.

Emulsion explosives are well known in the art and comprise a discontinuous phase comprising an oxygen releasing salt, a continuous fuel phase and an emulsifier component. Commercially-available emulsion explosives are commonly of the water-in-oil type wherein discrete droplets of an aqueous solution of an oxygen-releasing salt are dispersed as a discontinuous phase within a continuous organic fuel phase.

In some applications, the water content may be reduced to very low levels, for example, to less than 4% w/w, or even completely eliminated.

The provision of good storage stability and good stability under operating conditions is a major concern of explosives manufacturers. Droplets of the oxidizer phase of emulsion explosives are inherently metastable and exhibit a tendency to destabilise. Furthermore, emulsion explosives are commonly subjected to high shear and pressures during mixing and bore hole loading, which in many cases leads to loss of stability through droplet coalescence.

It is an object of this invention to provide an emulsion explosive which combines the features of long term stability against crystallisation and stability under mixing and loading conditions, and which can be prepared with a minimum of effort.

Accordingly, we provide an emulsion explosive comprising a discontinuous oxygen-releasing salt phase, a continuous fuel phase and an emulsifier blend, said emulsifier blend comprising a first emulsifier component consisting of at least one emulsifier comprising a lipophilic moiety, being a polymer of a $C_2$ to $C_6$ olefin, and a hydrophilic moiety, being deriveed from an amine wherein the HLB of the first emulsifier component, as herein defined, is in the range of from 1.0 to 1.3 and a second emulsifier component and wherein the HLB of the emulsifier blend, as herein defined is in the range of from 1.4 to 3.0.

The term HLB refers to the hydrophile-lipophile Balance of an emulsifier. The HLB of the emulsifier blend is in the range of from 1.4 to 3.0. The HLB of an emulsifier blend ($HLB_{Blend}$) is the sum of the weighted contributions of its components according to the formula:

$$HLB_{Blend}=\Sigma f_n \times HLB_n,$$

where $f_n$ is the weight fraction of the nth component in the emulsifier blend and $HLB_n$ is the HLB of the nth component. Preferably the HLB of the emulsifier blend is in the range of from 1.5 to 2.0.

The first emulsifier component consists of at least one emulsifier comprising a lipophilic moiety, being a polymer of a $C_2$ to $C_6$ olefin, and a hydrophilic moiety, being derived from an amine.

The lipophilic moiety is a polymer of a $C_2$ to $C_6$ olefin such as ethylene, propylene, 1-butene, isoprene and particularly preferred is isobutene. Typically, the lipophilic moiety will be a polymer chain with a molecular weight in the range of from 400 to 5000 and preferably in the range of from 400 to 2000. These ranges correspond to polymer chains of approximately 30 to 350 carbon atoms and from 30 to 140 carbon atoms respectively.

The hydrophilic moiety is derived from an amine, particularly preferred hydrophilic moieties are derived from primary amines. The term "primary amine group" refers to compounds comprising at least one primary amine moiety.

Examples of primary amines include aliphatic amines, cycloaliphatic amines, aromatic amines and heteroaromatic amines which primary amine groups may optionally be substituted with one or more substituents.

Typically, $C_1$ to $C_{20}$ aliphatic amines wherein the aliphatic chain may be straight or branched, preferably the aliphatic amine is a $C_1$ to $C_{20}$ alkyl amine. Specific examples of aliphatic amines include ethylamine, n-butylamine, allylamine, cocoa amine, tallow amine and lauryl amine.

Further examples include: hydroxy ($C_1$ to $C_{10}$ alkyl) amines such as ethanolamine and 3-hydroxypropylamine; amino ($C_1$ to $C_{10}$ alkyl) amine such as aminoethylamine; ($C_1$ to $C_{10}$ alkyl)amines substituted with the group amino($C_1$ to $C_{10}$ alkyl)amino-such as diethylenetriamine; ($C_1$ to $C_{10}$ alkyl)amine substituted with the group N,N-di($C_1$ to $C_4$ alkyl) amino such as dimethylaminopropylamine; phenyl ($C_1$ to $C_{10}$ alkyl) amines such as benzylamine; and heterocyclic substituted ($C_1$ to $C_{10}$ alkyl) amines such as described in our copending Australian Patent Application Number 29932/89.

Examples of cycloaliphalic amines include cyclohexylamine and cyclopentylamine. Aromatic amines include aniline. Heteroaromatic amines include aminopyridines.

Preferred primary amine groups include ($C_1$ to $C_4$ alkyl)amines, in particular ethanolamine, and N—N, di($C_1$ to $C_4$ alkyl)amino($C_1$ to $C_4$ alkyl) amines, in particular dimethylaminipropylamine.

The hydrophobic moiety and the hydrophilic moiety may be joined directly or be joined through a linking group. The linking group may be derived from a functional group. Suitable linking groups may, for example, include succinic acid or anhydride, phenol derived groups, or other group which serves to unite the lipophilic moiety and the hydrophilic moiety.

In a preferred embodiment, said first emulsifier is a condensation product of a poly(alkenyl)succinic acid and/or anhydride with a primary amine. The condensation may result in the formation of an amide, an imide or mixture thereof.

The determination of the HLB of emulsifiers containing lipophilic moieties being polymers of molecular weights greater than 400 is made difficult due to the dominating effect on HLB of the polymeric lipophilic moiety. In order to enable the HLB of such emulsifiers to be readily determined, and thus selected for use in accordance with the present invention, the following method may be used:

$$HLB=1+\Sigma\delta HLB$$

wherein HLB is the contribution to the HLB of the emulsifier provided by constituent functional groups which do not constitute part of the lipophilic polymer and are listed in Table 1.

TABLE I

HLB contributions of constituent functional groups.

| Functional Group | | δHLB |
|---|---|---|
| Alkanes | C—C | 0 |
| Alkenes | C=C | 0.06 |
| Alkynes | C≡C | 0.04 |

TABLE I-continued

| HLB contributions of constituent functional groups. | | |
|---|---|---|
| Functional Group | | δHLB |
| Aromatic rings | | 0.06 |
| Alcohols | C—OH | 0.03 |
| Ethers | C—O—C | 0.03 |
| Fluorides | C—F | 0.05 |
| Chlorides | C—Cl | 0.03 |
| Bromides | C—Br | 0 |
| Iodides | C-1 | 0 |
| Amines | $C—NR_2$ | 0.02 |
| Nitro | $C—NO_2$ | 0.03 |
| Sulfides | C—S—R | 0.02 |
| Sulfoxides | $C—SO_x—R$ | 0.02 |
| Aldehydes | R—CHO | 0.10 |
| Ketones | $R_2—C=O$ | 0.10 |
| Carboxylic | R—COOH | 0.08 |
| Salts | $R—COO^-$ | 0.09 |
| Esters | $R—COOR^1$ | 0.08 |
| Anhydrides | $(RCO)_2O$ | 0.08 |
| Amides | $RCO_2NR_2$ | 0.08 |
| Nitrites | R—C=N | 0.06 |
| Oximes | R—C=NOCH | 0.07 |
| Isocyanates | R—N=C=O | 0.06 |
| Cyanates | R—O—C=N | 0.05 |
| Isothiocyanate | R—N—C=S | 0.06 |
| Thiocyanates | R—S—C=N | 0.05 |
| Imide | $(RCO)_2N$ | 0.08 |

where R is hydrogen or alkyl

The following examples illustrate the application of this method in determining the HLB of emulsifiers which contain lipophilic moieties being polymers of molecular weights greater than 400.

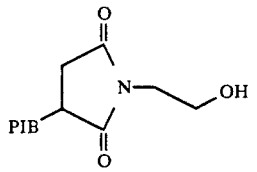

PIB is polyisobutylene.

Condensation product of 1:1 molar ratio polyisobutylene succinic anhydride and ethanolamine. HLB determined by the contribution of two ketones, one amino and one alcohol (alkyl group contribution is zero).

$$HLB = 1 + (0.10 + 0.10 + 0.02 + 0.03) = 1.25$$

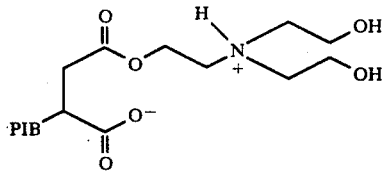

PIB is polyisobutylene.

Condensation product of 1:1 ratio polyisobutylene succinic anhydride and triethanolamine. HLB determined by the contribution of one ester, one carboxylic salt, two alcohols and one amine.

$$HLB = 1 + (0.08 + 0.09 + 0.03 + 0.03 + 0.02) = 1.227$$

The second emulsifier component may be any conventional water-in-oil emulsifier in an amount and of an HLB value sufficient to provide the emulsifier blend with an HLB in the range of from 1.4 to 3.0. HLB values of conventional emulsifiers are known in the art and may be found in literature relating to emulsifiers and detergents, for example McCutcheon's books on "Emulsifiers and Detergents".

Examples of conventional water-in-oil emulsifiers include alcohol alkoxylates, phenol alkoxylates, poly(oxyalkylene) glycols, poly(oxyalkylene) fatty acid esters, amine alkoxylates, fatty acid esters of sorbitol and glycerol, fatty acid salts, sorbitan esters, poly(oxyalkylene) sorbitan esters, fatty amine alkoxylates, poly(oxyalkylene) glycol esters, fatty acid amides, fatty acid amide alkoxylates, fatty amines, quaternary amines, alkyloxazolines, alkenyloxazolines, imidazolines, alkylsulfonates, alkylarylsulfonates, alkylsulfosuccinates, alkylphosphates, alkenylphosphates, phosphate esters, lecithin, copolymers of poly(oxyalkylene) glycols and poly(12-hydroxystearic acid), and mixtures thereof. Among the preferred emulsifying agents are the 2-alkyl- and 2-alkenyl-4,4'-bis(hydroxymethyl) oxazoline, the fatty acid esters of sorbitol, lecithin, copolymers of poly(oxyalkylene) glycols and poly(12-hydroxystearic acid), and mixtures thereof, and particularly sorbitan monooleate, sorbitan sesquioleate, 2-oleyl-4,4'-bis(hydroxymethyl) oxazoline, mixture of sorbitan sesquioleate, lecithin and a copolymer of poly(oxyalkylene) glycol and poly(12-hydroxystearic acid), and mixtures thereof.

Particularly preferred second emulsifier components include sorbitan esters such as those selected from the group consisting of sorbitan monooleate, sorbitan trioleate, sorbitan sesquioleate, sorbitan tallate and sorbitan laurate.

It is preferred that the second emulsifier component has an HLB of at least 3 and preferably in the range of from 3.5 to 30, more preferably 3.5 to 10.

Emulsifier blends typically consist of a first emulsifier component and a second emulsifier component but may also contain further components such as vehicles or carries for the emulsifiers, for example oils such as diesel oils or paraffin oils;

When the emulsifier blend consists of a first emulsifier component and a second emulsifier component the first emulsifier component will generally comprise from 20 to 99% of the emulsifier blend and preferably from 50 to 98% and most preferably from 80 to 95%, by weight of the emulsifier blend.

When the emulsifier blend consists of a first emulsifier component and a sorbitan ester, the sorbitan ester will generally comprise from 1 to 25%, preferably from 1 to 20% and more preferably 2 to 15% by weight of the emulsifier blend.

The emulsifier blend is preferably present in the range 0.2 to 10% by weight of the resultant emulsion. Typically up to 5% may be used, however, higher proportions of the blend of emulsifiers may be used and may serve as a supplemental fuel for the composition, but in general it is not necessary to add more than 5% by weight of the emulsifier blend to achieve the desired effect. Stable emulsions can be formed using relatively low levels of the blend of emulsifiers, and for reasons of economy it is preferable to keep the amount to the minimum required to achieve the desired effect. More preferably, the level of the emulsifier blend used is in the range from 1.0 to 3.0% by weight of the resultant composition, and most preferably in the range of from 1.4 to 2%.

The water-immiscible organic fuel of the present emulsion explosive comprises the continuous "oil" phase of the emulsion explosive and acts as a fuel. Suitable organic fuels include aliphatic, alicyclic and aromatic compounds and mixtures thereof which are in the liquid state at the formulation temperature. Suitable organic fuels may be chosen from fuel oil, diesel oil, distillate, kerosene, naphtha, paraffin oils, benzene, toluene, xylenes asphaltic materials, polymeric oils such as the low molecular weight polymers of olefins, animal oils, fish oils, and other mineral, hydrocarbon or fatty oils, and mixtures thereof. Preferred organic fuels are the liquid hydrocarbons generally referred to as petroleum distillates such as gasoline, kerosene, fuel oils and paraffin oils.

Typically, the water-immiscible organic phase of the emulsion explosive component comprises from 2 to 15% by weight and preferably 3 to 10% by weight of the emulsions component of the composition.

Suitable oxygen-releasing salts for use in the discontinuous oxygen-releasing salt phase of the emulsion explosive include the alkali and alkaline earth metal nitrates, chlorates and perchlorates, ammonium nitrate, ammonium chlorate, ammonium perchlorate and mixtures thereof. The preferred oxygen-releasing salts include ammonium nitrate.

Typically, the discontinuous oxygen-releasing salt phase of the emulsion compositions comprises from 45 to 95% and preferably from 60 to 90% by weight of the emulsion component.

Typically, the amount of water employed in the compositions of the present invention is in the range of from 0 to 30% by weight of the total composition. Preferably the amount employed is from 4 to 25%, and more preferably from 6 to 20%, by weight of the total composition.

If desired, other, optional fuel materials, hereinafter referred to as secondary fuels, may be incorporated into the emulsions. Examples of such secondary fuels include finely divided solids, and water-miscible organic liquids which can be used to partially replace water as a solvent for the oxygen-releasing salts or to extend the aqueous solvent for the oxygen-releasing salts.

Examples of solid secondary fuels include finely divided materials such as: sulfur; aluminium; carbonaceous materials such as gilsonite, comminuted coke or charcoal, carbon black, resin acids such as abietic acid, sugars such as glucose or dextrose and other vegetable products such as starch, nut meal, grain meal and wood pulp; and mixtures thereof.

Examples of water-miscible organic liquids include alcohols such as methanol, glycols such as ethylene glycol, amides such as formamide and amines such as methylamine.

Typically, the optional secondary fuel component of the emulsion comprises from 0 to 30% by weight of the emulsion composition.

The emulsion explosive compositions of the present invention may additionally incorporate ammonium nitrate particles. The term ammonium nitrate particles refers to ammonium nitrate in the form of prills or prills coated with fuel oil (commonly known as "ANFO"), for example, ammonium nitrate particles coated with fuel oil to the extent of from 2 to 15% w/w of prills.

It is preferred that such a composition will be mixed in the ratio of emulsion component to ammonium nitrate particles in the range of from 95:5 to 20:80, preferably 70:30 to 20:80.

The emulsion explosive compositions for use in the process of the present invention may additionally comprise a discontinuous gaseous component.

The methods of incorporating a gaseous component and the enhanced sensitivity of emulsion explosive compositions comprising such gaseous components have been previously reported. Typically, where used the said gaseous component will be present in an amount required to reduce the density of the composition to which the range 0.8 to 1.4 gm/cc.

The gaseous component may, for example, be incorporated into the composition of the present invention as fine gas bubbles dispersed through the composition, as hollow particles which are often referred to as microballoons or microspheres, as porous particles, or mixtures thereof.

A discontinuous phase of fine bubbles may be incorporated into the compositions of the present invention by mechanical agitation, injection or bubbling the gas through the composition, or by chemical generation of gas in situ.

Suitable chemicals for the in situ generation of gas bubbles include peroxides, such as hydrogen peroxide, nitrites, such as sodium nitrite, nitrosoamines, such as N,N'-dinitrosopentamethylenetetramine, alkali metal borohydrides, such as sodium borohydride, and carbonates, such as sodium carbonate. Preferred chemicals for the in situ generation of gas bubbles are nitrous acid and its salts which decompose under conditions of acid pH to produce gas bubbles. Catalytic agents such as thiocyanate or thiourea may be used to accelerate the decomposition of a nitrite gassing agent. Suitable small hollow particles include small hollow microspheres of glass or resinous materials, such as phenol-formaldehyde and urea-formaldehyde. Suitable porous materials include expanded minerals, such as perlite.

Where used, the gaseous agent is preferably added during cooling, after preparation of the emulsion, and typically comprises 0.05 to 50% by volume of the total emulsion explosive composition at ambient temperature and pressure. More preferably, where used, the gaseous component is present in the range 10 to 30% by volume of the emulsion explosive composition and preferably the bubble size of the occluded gas is below 200 μm, more preferably at least 50% of the gas component will be in the form of bubbles or microspheres of 20 to 90 μm internal diameter.

Compositions of the present invention combine not only ease of formation and long term stability but also provide significant advantages in the refinement of emulsions. The advantages in refinement are demonstrated by significantly reduced refinement times.

Compositions of the present invention exhibit improved tolerance to shear allowing repumping and greater ease of handling.

The emulsion explosive compositions of the present invention may be prepared by a number of methods. One preferred method of manufacture includes: dissolving the oxygen-releasing salts in water at a temperature above the fudge point of the salt solution, preferably at a temperature in the range from 25° to 110° C., to give an aqueous salt solutions; combining said aqueous salt solution, said water-immiscible organic fuel and the emulsifier blend, with rapid mixing to form a water-in-oil emulsion; and mixing until the emulsion is uniform and of the required refinement.

The invention is now illustrated by, but not limited to the following examples.

The following examples of emulsions are suitable for use as bulk explosives and the properties of these emulsions are summarized at Table II.

EXAMPLE 1 (E1)

An emulsion explosive of the type suitable for use as a bulk explosive was prepared using the following components according to the procedure below.

| COMPONENT | PART W/W % |
|---|---|
| Chemically Pure Ammonium Nitrate | 73.90 |
| Water | 18.50 |
| Paraffin Oil | 6.39 |
| EMULSIFIER BLEND | |
| First Emulsifier Component* (HLB 1.2) | 1.02 |
| Sorbitan Monooleate (HLB 4.3) | 0.19 |

*The first emulsifier component was 1:1 molar condensation product of polyisobutylenesuccinic anhydride and ethanolamine and had an HLB of 1.2.

The HLB of the emulsifier blend was 1.69.

The Chemically Pure Ammonium Nitrate was dissolved in water at 70° C. and the solution was added to a stirred mixture of Parrafin Oil and Emulsifier Blend. A Hobart N50 Planetary Mixer with a whisk attachment was used at speed 2 for 2 minutes to form a coarse emulsion. The coarse emulsion was observed to form easily.

The coarse emulsion was refined to a primary emulsion of viscosity in the range of from 17,000 to 18,000 centipoise with the N50 Mixer at speed 3 with the whisk attachment. Refining the coarse emulsion for 60 seconds yielded a primary emulsion of viscosity 18,000 centipoise.

The droplet size of the primary emulsion was typically in the range of 4 to 10 μm. The conductivity of the primary emulsion at 24° C. was 127 $pSm^{-1}$.

After 5 weeks storage at ambient temperature the crystallization level of the emulsion remained very low, rated 1 on a scale of 1 to 10 where 1 is no observable crystallization and 10 is completely crystalline.

EXAMPLE 2 (E2)

An emulsion explosive of the type suitable for use as a bulk explosive was prepared using the following components according to the procedure below.

| COMPONENT | PART W/W % |
|---|---|
| Chemically Pure ammonium Nitrate | 73.90 |
| Water | 18.50 |
| Paraffin Oil | 6.20 |
| EMULSIFIER BLEND | |
| First Emulsifier Component* (HLB 1.2) | 1.31 |
| Sorbitan Monooleate (HLB 4.3) | 0.09 |

*The first emulsifier component was a 1:1 molar condensation product of polyisobutylenesuccinic anhydride and ethanolamine and had an HLB of 1.2.

The HLB of the emulsifier blend was 1.40.

The Chemically Pure Ammonium Nitrate was dissolved in water at 70° C. and the solution was added to a stirred mixture of Paraffin Oil and Emulsifier Blend. A Hobart N50 Planetary Mixer with a whisk attachment was used at speed 2 for 2 minutes to form a coarse emulsion. The coarse emulsion was observed to form easily.

The coarse emulsion was refined to a primary emulsion of viscosity in the range of from 17,000 to 18,000 centipoise with the N50 Mixer at speed 3 with the whisk attachment. Refining the coarse emulsion for 45 seconds yielded a primary emulsion of viscosity 18,000 centipoise.

The droplet size of the primary emulsion was typically in the range of 4 to 12 μm. The conductivity of the primary emulsion at 24° C. was 109 $pSm^{-1}$.

A portion of the primary emulsion was stored at ambient temperature and after 5 weeks storage the level of crystallization remained very low, rated 1 on the scale described at Example 1.

COMPARATIVE EXAMPLE A (CEA)

An emulsion explosive of the type suitable for use as a bulk explosive was prepared using the following components according to the procedure below.

| COMPONENT | PART W/W % |
|---|---|
| Chemically Pure Ammonium Nitrate | 73.90 |
| Water | 18.50 |
| Paraffin Oil | 6.39 |
| EMULSIFIER | |
| Sorbitan monooleate (HLB 4.3) | 1.21 |

The Chemically Pure Ammonium Nitrate was dissolved in water at 70° C. and the solution was added to a stirred mixture of Paraffin Oil and Emulsifier. A Hobart N50 Planetary Mixer with a whisk attachment was used at speed 2 for 2 minutes to form a coarse emulsion. The coarse emulsion was observed to form very easily.

The coarse emulsion was refined to a primary emulsion of viscosity in the range of from 17,000 to 18,000 centipoise with the N50 Mixer at speed 3 with the whisk attachment. Refining the coarse emulsion for 75 seconds yielded a primary emulsion of viscosity 17,200 centipoise.

The droplet size of the primary emulsion was typically in the range of 2 to 9 μm. The conductivity of the primary emulsion at 23° C. was 12700 $pSm^{-1}$.

A portion of the primary emulsion was stored at ambient temperature and after 5 weeks storage the level of crystallization was fair, rated 3 on the scale described at Example 1.

COMPARATIVE EXAMPLE B (CEB)

An emulsion explosive of the type suitable for use as a bulk explosive was prepared using the following components according to the procedure below.

| COMPONENT | PART W/W % |
|---|---|
| Chemically Pure Ammonium Nitrate | 73.90 |
| Water | 18.50 |
| Paraffin Oil | 6.39 |
| EMULSIFIER | |
| Emulsifier Component* (HLB 1.2) | 1.02 |

*The emulsifier component was a 1:1 molar condensation product of polyisobutylenesuccinic anhydride and ethanolamine and had an HLB of 1.2.

The Chemically Pure Ammonium Nitrate was dissolved in water at 70° C. and the solution was added to a stirred mixture of Paraffin Oil and Emulsifier Blend. A Hobart N50 Planetary Mixer with a whisk attachment was used at speed 2 for 2 minutes to form a coarse emulsion. The coarse emulsion was observed to form fairly easily.

The coarse emulsion was refined to a primary emulsion of viscosity in the range of from 17,000 to 18,000 centipoise with the N50 Mixer at speed 3 with the whisk attachment. Refining the coarse emulsion for 75 seconds yielded a primary emulsion of viscosity 17,600 centipoise.

The droplet size of the primary emulsion was typically in the range of 4 to 16 μm. The conductivity of the primary emulsion at 27° C. was 127 $pSm^{-1}$.

A portion of the primary emulsion was stored at ambient temperatute and after 5 weeks storage the level of crystallization was very low, rated 1 on the scale described at Example 1.

TABLE II

| Example | A | B | C | D | E |
|---|---|---|---|---|---|
| E1 | Easy | 60 | 4–10 | 127 | 1 |
| E2 | Easy | 45 | 4–12 | 109 | 1 |
| CEA | Very Easy | 75 | 2–9 | 12700 | 3 |
| CEB | Fairly Easy | 75 | 4–16 | 127 | 1 |

A- Coarse Emulsion Formation
B- Refinement Time (Seconds)
C- Droplet Size (micrometers)
D- Emulsion Conductivity At About 25° C. ($pSm^{-1}$)
E- Crystallization After 5 Weeks At Ambient The following examples illustrate some of the advantages of the compositions of the present invention in packaged explosives. The results of the following examples are summarized at Table III.

EXAMPLE 3 (E3)

An emulsion explosive of the type suitable for use as a bulk explosive was prepared using the following components according to the procedure below.

| COMPONENT | PART W/W % |
|---|---|
| Chemically Pure Ammonium Nitrate | 70.52 |
| Sodium Perchlorate | 9.11 |
| Water | 7.97 |
| Paraffin Oil | 0.98 |
| Wax | 2.45 |
| EMULSIFIER BLEND | |
| First Emulsifier Component* (HLB 1.2) | 0.94 |
| Sorbitan monooleate (HLB 4.3) | 0.23 |
| SOLID SENSITIZERS | |
| Aluminium (−200 #) | 5.80 |
| Microballoons (3M, B23-500) | 2.00 |

*The first emulsifier component was a 1:1 molar condensation product of polyisobutylenesuccinic anhydride and ethanolamine and had an HLB of 1.2.

The HLB of the emulsifier blend was 1.81.

The Chemically Pure Ammonium Nitrate and Sodium Perchlorate was dissolved in water at 90° C. and the solution was added to a stirred mixture of Paraffin Oil and Emulsifier Blend. A Hobart N50 Planetary Mixer with a whisk attachment was used at speed 2 for 2 minutes to form a coarse emulsion. The coarse emulsion was observed to form easily.

The coarse emulsion was refined to a primary emulsion of viscosity in the range of from 17,000 to 18,000 centipoise with the N50 Mixer at speed 3 with the whisk attachment. Refining the coarse emulsion for 75 seconds yielded a primary emulsion of viscosity 17,000 centipoise.

The droplet size of the primary emulsion was typically in the range of 3 to 8 μm. The conductivity of the primary emulsion at 27° C. was 3.73 $pSm^{-1}$ and 7240 $pSm^{-1}$ at 75° C. Crystallization levels in the primary emulsion after cooling to ambient temperature were very low.

The shear crystallization temperature of the primary emulsion was determined by rapidly inserting an aluminium probe attached to a thermocouple into the emulsion. the thermocouple is attached to a digital thermometer with a peak hold facility. The resultant temperature rise from the thermocouple penetration was taken as a measure of the emulsion susceptibility to shear. The shear crystallization temperature was found to be 15.6° C.

COMPARATIVE EXAMPLE C (CEC)

An emulsion explosive of the type suitable for use as a packaged explosive was prepared using the following components according to the procedure below.

| COMPONENT | PART W/W % |
|---|---|
| Chemically Pure Ammonium Nitrate | 70.52 |
| Sodium Perchlorate | 9.11 |
| Water | 7.97 |
| Paraffin Oil | 0.98 |
| Wax | 2.45 |
| EMULSIFIER BLEND | |
| Sorbitan monooleate (HLB 4.3) | 1.17 |
| SOLID SENSITIZERS | |
| Aluminium | 5.80 |
| Microballoons | 2.00 |

The Chemically Pure Ammonium Nitrate and Sodium Perchlorate was dissolved in water at 90° C. and the solution was added to a stirred mixture of Paraffin Oil Wax and Emulsifier. A Hobart N50 Planetary Mixer with a whisk attachment was used at speed 2 for 2 minutes to form a coarse emulsion. The coarse emulsion was observed to form very easily.

The coarse emulsion was refined to a primary emulsion of viscosity in the range of from 17,000 to 18,000 centipoise with the N50 Mixer at speed 3 with the whisk attachment. Refining the coarse emulsion for 300 seconds yielded a primary emulsion of viscosity 17,000 centipoise.

The droplet size of the primary emulsion was typically in the range of 2 to 5 μm. The conductivity of the primary emulsion at 27° C. was 231 $pSm^{-1}$ and $1.09\times10^{6}$ $pSm^{-1}$ at 79° C. Crystallization levels in the primary emulsion after cooling to ambient temperature were fairly low.

The shear crystallization temperature of the primary emulsion was found to be 8.8° C.

The solid sensitizers were then blended into the emulsion using a leaf paddle attachment at speed 1 for 1 minute. The crystallization was observed to remain fairly low.

COMPARATIVE EXAMPLE D (CED)

An emulsion explosive of the type suitable for use as a packaged explosive was prepared using the following components according to the procedure below.

| COMPONENT | PART W/W % |
|---|---|
| Chemically Pure Ammonium Nitrate | 70.52 |
| Sodium Perchlorate | 9.11 |
| Water | 7.97 |
| Paraffin Oil | 0.98 |
| Wax | 2.45 |

-continued

| COMPONENT | PART W/W % |
|---|---|
| EMULSIFIER | |
| Emulsified component* (HLB 1.2) | 1.17 |
| SOLID SENSITIZERS | |
| Aluminium | 5.80 |
| Microballoons | 2.00 |

*The emulsifier component was a 1:1 molar condensation product of polyisobutylenesuccinic anhydride and ethanolamine and had an HLB of 1.2.

The Chemically Pure Ammonium Nitrate and sodium perchlorate was dissolved in water at 90° C. and the solution was added to a stirred mixture of Paraffin Oil Wax and Emulsifier. A Hobart N50 Planetary Mixer with a whisk attachment was used at speed 2 for 2 minutes to form a coarse emulsion. The coarse emulsion was observed to form fairly easily.

The coarse emulsion was refined to a primary emulsion of viscosity in the range of from 17,000 to 18,000 centipoise with the N50 Mixer at speed 3 with the whisk attachment. Refining the coarse emulsion for 120 seconds yielded a primary emulsion of viscosity 18,000 centipoise.

The droplet size of the primary emulsion was typically in the range of 3 to 7 μm. The conductivity of the primary emulsion at 27° C. was 0.158 $pSm^{-1}$ and 852 $pSm^{-1}$ at 83° C. Crystallization levels in the primary emulsion after cooling to ambient temperature were very low.

The shear crystallization temperature of the primary emulsion was found to be 17.1° C.

The solid sensitizers were then blended into the emulsion using a leaf paddle attachment at speed 1 for 1 minute. The crystallization was observed to remain very low.

TABLE III

| # | A | B | C | F | G | H |
|---|---|---|---|---|---|---|
| E3 | Easy | 75 | 3-8 | 7240 | Very low | 15.6 |
| CEA | Very Easy | 300 | 2-5 | $1.09 \times 10^6$ | Fairly low | 8.8 |
| CEB | Fairly Easy | 120 | 3-7 | 852 | Very low | 17.1 |

#- Example
A- Coarse Emulsion Formation
B- Refinement Time (Seconds)
C- Droplet Size (micrometers)
F- Emulsion Conductivity At About 80° C. ($pSm^{-1}$)
G- Crystallization in Cooled Primary Emulsion
H- Shear Crystallization Temperature (°C.)

The claims defining the invention are as follows:

1. An emulsion explosive comprising a discontinuous oxygen-releasing salt phase, a continuous fuel phase and an emulsifier blend, said emulsifier blend comprising a first emulsifier component consisting of at least one emulsifier comprising a lipophilic moiety, being a polymer of a $C_2$ to $C_6$ olefin, and a hydrophilic moiety, being derived from an amine wherein the HLB of the first emulsifier component, as herein defined, is in the range of from 1.0 to 1.3 and a second emulsifier component and wherein the HLB of the emulsifier blend, as herein defined is in the range of from 1.4 to 3.0.

2. An emulsion explosive according to claim 1 wherein the HLB of the emulsifier blend is in the range of from 1.5 to 2.0.

3. An emulsion explosive according to either claims 1 or 2 wherein the lipophilic moiety will be a polymer chain with a molecular weight in the range of from 400 to 5000.

4. An emulsion explosive according to any one of claims 1 to 3 wherein the lipophilic moiety will be a polymer chain with a molecular weight in the range of from 400 to 2000.

5. An emulsion explosive according to any one of claims 1 to 4 wherein the lipophilic moiety is a polymer of a $C_2$ to $C_6$ olefin selected from the group consisting of ethylene, propylene, 1-butene, isoprene and isobutene.

6. An emulsion explosive according to any one of claims 1 to 5 wherein the lipophilic moiety is a polymer of isobutene.

7. An emulsion explosive according to any one of claims 1 to 6 wherein the hydrophilic moiety is derived from a primary amine.

8. An emulsion explosive according to any one of claims 1 to 7 wherein the hydrophilic moiety is derived from a primary amine selected from the group consisting of aliphatic amines, cycloaliphatic amines, aromatic amines and heteroaromatic amines which primary amine groups may optionally be substituted with one or more substituents.

9. An emulsion explosive according to any one of claims 1 to 8 wherein the hydrophilic moiety is derived from a primary amine selected from the group consisting of ethanolamine and dimethylaminopropylamine.

10. An emulsion explosive comprising a discontinuous oxygen-releasing salt phase, a continuous fuel phase and an emulsifier blend, said emulsifier blend comprising a first emulsifier component consisting of at least one emulsifier comprising a lipophilic moiety, being a polymer of a $C_2$ to $C_6$ olefin, and a hydrophilic moiety, being derived from an amine and a second emulsifier component being a sorbitan ester wherein said emulsifier blend comprises from 1 to 25% sorbitan ester by weight of the emulsifier blend.

11. An emulsion explosive according to any one of claims 1 to 10 wherein the lipophilic and hydrophilic moieties are joined directly or joined through a linking group derived from a functional group.

12. An emulsion explosive according to any one of claims 1 to 11 wherein the lipophilic and hydrophilic moieties are joined through a linking group selected from the group consisting of succinic acid, succinic anhydride and phenol derived groups.

13. An emulsion explosive according to any one of claims 1 to 12 wherein said first emulsifier is a condensation product of a poly(alkenyl)succinic acid and/or anhydride with a primary amine which condensation product is an amide, an imide or mixture thereof.

14. An emulsion explosive according to any one of claims 1 to 9 and claims 11 to 13 wherein the second emulsifier component is a conventional emulsifier selected from the group consisting of alcohol alkoxylates, phenol 15 alkoxylates, poly(oxyalkylene) glycols, poly(oxyalkylene) fatty acids esters, amine alkoxylates, fatty acid esters of sorbitol and glycerol, fatty acid salts, sorbitan esters, poly(oxyalkylene) sorbitan esters, fatty amine alkoxylates, poly(oxyalkylene) glycol esters, fatty acid amides, fatty acid amide alkoxylates, fatty amines, quaternary amines, alkyloxazolines, alkenyloxazolines, imidazolines, alkyl-sulfonates, alkylarylsulfonates, alkylsulfosuccinates, alkylphosphates, alkenylphosphates, phosphate esters, lecithin, copolymers of poly(oxyalkylene) glycols and poly(12-hydroxystearic acid), and mixtures thereof.

15. An emulsion explosive according to claim 14 wherein the second emulsifier compoent has an HLB of at least 3.

16. An emulsion explosive according to claim 15 wherein the second emulsifier component has an HLB in the range of from 3.5 to 30.

17. An emulsion explosive according to claim 16 wherein the second emulsifier component has an HLB in the range of from 3.5 to 10.

18. An emulsion explosive according to any one of claims 1 to 17 wherein the second emulsifier component is selected from the group consisting of sorbitan sesquioleate, sorbitan tallate and sorbitan laurate.

19. An emulsion explosive according to any one of claims 1 to 9 and claims 11 to 17 wherein the first emulsifier component comprises from 20 to 99% by weight of the emulsifier blend.

20. An emulsion explosive composition according to claim 19 wherein the first emulsifier component comprises from 50 to 98% by weight of the emulsifier blend.

21. An emulsifier explosive composition according to either of claims 19 or 20 wherein the first emulsifier component comprises from 80 to 95% by weight of the emulsifier blend.

22. An emulsion explosive composition according to claim 18 wherein the sorbitan ester comprises from 1 to 25% by weight of the emulsifier blend.

23. An emulsion explosive composition according to claim 22 wherein the sorbitan ester comprises from 1 to 20% by weight of the emulsifier blend.

24. An emulsion explosive composition according to claim 22 wherein the sorbitan ester comprises from 2 to 15% by weight of the emulsifier blend.

25. An emulsion explosive according to any one of claims 1 to 24 wherein the emulsifier blend comprises from 2 to 10% by weight of the emulsion explosive.

26. An emulsion explosive according to any one of claims 1 to 25 wherein the emulsifier blend comprises from 1.0 to 3.0% by weight of the emulsion explosive.

27. An emulsion explosive according to any one of claims 1 to 26 wherein the emulsifier blend comprises from 1.4 to 2.0% by weight of the emulsion explosive.

* * * * *